US005826128A

United States Patent [19]

Nishida

[11] Patent Number: 5,826,128

[45] Date of Patent: Oct. 20, 1998

[54] APPARATUS FOR PROCESSING PHOTOSENSITIVE MATERIAL

[75] Inventor: Yoshio Nishida, Wakayama, Japan

[73] Assignee: Noritsu Koki Co., Ltd., Wakayama, Japan

[21] Appl. No.: 693,456

[22] Filed: Aug. 7, 1996

[30] Foreign Application Priority Data

Aug. 31, 1995 [JP] Japan ..... 7-223378

[51] Int. Cl.[6] ..... G03D 7/00; G03D 13/00

[52] U.S. Cl. ..... 396/572; 396/578; 396/579; 399/33; 399/69; 399/44; 34/467; 34/471; 34/476

[58] Field of Search ..... 355/27, 30; 399/9, 399/33, 44, 69, 77, 92, 94, 93; 396/572, 571, 579, 578; 34/444, 461, 471, 476; 431/20; 53/492

[56] References Cited

U.S. PATENT DOCUMENTS

| | | | |
|---|---|---|---|
| 3,822,523 | 7/1974 | Russell et al. | 53/492 |
| 4,556,310 | 12/1985 | Masuda | 399/77 |
| 5,021,831 | 6/1991 | Tonomoto | 399/93 |
| 5,222,888 | 6/1993 | Jones et al. | 431/20 |
| 5,235,370 | 8/1993 | Samuels et al. | 396/572 |

*Primary Examiner*—D. Rutledge
*Attorney, Agent, or Firm*—Armstrong, Westerman, Hattori, McLeland & Naughton

[57] ABSTRACT

A processing apparatus including a drying part provided with at least a drying fan and a drying heater to automatically develop a photosensitive material wherein the drying part further includes a means for detecting reduction in air amount of the drying fan.

8 Claims, 6 Drawing Sheets

APPARATUS FOR PROCESSING PHOTOSENSITIVE MATERIAL

BACKGROUND OF THE INVENTION

The present invention relates to an apparatus for processing photosensitive materials, and more particularly, to an apparatus for processing photosensitive materials where photosensitive materials clogged in the inside of a drying part can be reduced in amount by earlier discovery of abnormal operation of a drying fan of the drying part to stop the processing operation, and the sensitivity is independent of external temperatures for obtaining high reliability.

Conventionally, a photosensitive material processing apparatus (hereinafter referred to as processing apparatus) for automatically developing photosensitive materials such as paper (photographic paper) effects developing, bleaching, fixing and washing operations in the development part, with transferring the paper along the transfer route by a roller, and then a drying operation of the paper is effected in the drying part.

The drying part used conventionally is shown in FIGS. 5 through 6. The drying part comprises a transfer route 31 having a turn part T at which an emulsion face E of the paper P faces externally; a hot blast supplying means 32 composed of a drying fan 33 provided on the outside of the turn portion T, a drying heater 34 and an exhaust duct 35; a plurality of turn rollers 36 provided along the inner side of the turn part T; and a paper guide 37 provided between two rollers of the plurality of turn rollers 36 adjacent to each other so as not to contact with the paper P and having an opening through which the hot blast passes. Numerals 38 and 39 are transfer roller and guide plate spaced properly in distance along the linear portion of the transfer route 31.

The drying part thus composed is roller-transferring the paper P with the use of the air pressure of the drying fan 33. Namely, wind caused by the drying fan 33 is heated by the drying heater 34, then dispersed through the exhaust duct 35, and is sprayed to each location of the paper P from a slit (not shown). Since the paper P is pressed against the surface of the turn roller 36 or of the transfer roller 38, smooth transferring operation can be effected by the roller without causing slide or deflection.

In the transfer method using such air pressure, the paper P is not depressed any longer against the rollers 36 and 38 with sufficient depressing force when the air amount is lowered by abnormal operation such as stop of the drying fan, thus resulting in impossible paper transferring operation. Therefore, problems of paper clogging or the like are caused in the inside of the drying part.

Conventionally, the abnormal operations such as dying fan stop are detected indirectly by various means.

For example, there is a processing apparatus which issues warnings such as buzzer, with an object of fire prevention, by the detection of abnormal temperature rise within the interior of the duct 41 with the use of a thermostat 40 to prevent overheating in the inside of the drying part as shown in FIG. 6. In the processing apparatus, the abnormal operation of the drying fan is detected indirectly by detection of the abnormal temperature with the use of the thermostat 40, because the temperature of the inside of the duct 41 rises because of the reduction in the air amount when the abnormal operation such as the drying fan stop occurs. In the drying part shown in FIG. 6 where the drying heater 34 is disposed in the interior of the duct 41 on the upstream side of the drying fan 33, hot blast is fed to each location of the paper through the exhaust duct (not shown) provided on the downstream side of the drying fan 33 like in the case of FIG. 5.

Also, there is also a method of detecting the abnormal temperature of the inside of the drying part to directly detect the abnormal operation of the drying fan by the use of the thermistor sensor (so-called heat-sensitive rod) for observing whether or not the temperature of the inside of the drying part is a set value, in addition to the above-mentioned thermostat for preventing overheat.

Further, there is another method of, by provision of a means for detecting the passing of the paper in the final exit portion of the drying part, detecting whether or not the paper has passed the final exit portion after the given time lapse required to process a series of paper, and judging that the paper has been clogged by the abnormal drying fan or the like if the paper does not pass to issue the warning.

In the detecting means for detecting the temperature rise or the paper clogging, the processing operation does not stop till a given time lapse from the insertion of the paper into the processing apparatus interior if the abnormal drying fan is detected indirectly. In the delivery from the printer provided on the upstream of the drying part, the delivering operation is to be prohibited after all the paper being delivered has been transferred to the drying part even when the warning has been issued.

Though the warning is issued in the abnormal detection of the drying fan or the upper clogging detection using the temperature by the thermostat or the like, some time is required to the stop of the transfer of the paper from issuance of the warning. The delivering from the printer requires some time to the prohibition as described above because the delivery is prohibited after the delivering operation for the paper being delivered has been completed. Paper loss is more, because successive paper is transferred into the drying part under a condition where the paper has been clogged during time from occurrence of abnormal drying fan abnormality to stop of the paper transportation.

Timing for issuing warning is not certain, with a problem that sufficient reliability is not obtained, because in case of detecting the abnormal operation of the drying fan by the temperature detecting means such as thermostats and thermistor sensors, the sensitivity is influenced by external temperatures.

The present invention is made to remove such problems. An object of the present invention is to provide a processing apparatus which is capable of reducing the amount of clogged photosensitive materials in the inside of the drying part by earlier discovery of the abnormal drying fan operation of the drying part to stop the processing, and of providing higher reliability with sensitivity not influenced by external temperatures.

SUMMARY OF THE INVENTION

In accordance with a processing apparatus of a first invention, there is provided a processing apparatus including a drying part provided with at least a drying fan and a drying heater to automatically develop a photosensitive material wherein the drying part further includes a means for detecting reduction in air amount of the drying fan.

The means for detecting reduction in air amount is preferably comprises:

(a) a rotary shaft supported rotatably within an duct which is upstream or downstream of the drying fan;

(b) a flapper secured to the rotary shaft;

(c) a detecting plate secured to one end of the rotary shaft; and (d) a detector capable of detecting movement of the rotary shaft by the detecting plate when the air amount of the drying fan has been reduced.

The means for detecting reduction of air amount is preferably comprises an air amount sensor or an air pressure sensor.

In addition to the means for detecting reduction in air amount, the apparatus preferably includes a means for detecting rise of temperature in the inside of the drying part and a means for detecting clogging of photosensitive material in the inside of the drying part, and controls processing of the photosensitive material based on the abnormal detection signal to be obtained from the three types of detecting means.

In accordance with a processing apparatus of a second invention, there is provided a processing apparatus including a drying part provided with at least a drying fan and a drying heater to automatically develop a photosensitive material wherein the drying part further includes a rotation detecting sensor for detecting reduction of rotation speed of a driving shaft or an output shaft of the drying fan.

In addition to the rotation detecting sensor for detecting reduction in rotation speed of the drying shaft or output shaft of the drying fan, the apparatus preferably includes a means for detecting rise of temperature in the inside of the drying part and a means for detecting clogging of photosensitive material in the inside of the drying part, and controls processing of the photosensitive materials based on the abnormal detection signal to be obtained from the three types of detecting means.

Further, the apparatus preferably includes at least one warning means, and control of processing of the photosensitive material includes to issue warnings by the warning means and to stop the processing of the photosensitive material.

The processing apparatus in accordance with the first invention reduces paper loss, because the drying part has a means for detecting reduction in air amount of the drying fan so that the operation of the warning means, the operation of the paper transferring or the like can be quickly effected by the direct and quick detection of the abnormal drying fan operation.

The processing apparatus in accordance with the second invention reduces paper loss, because the rotation detecting sensor for detecting reduction in rotation speed of the driving shaft or the output shaft of the drying fan is provided so that the operation of the warning means, the operation of paper delivery or the like can be quickly effected by the direct and quick detection of the abnormal drying fan operation.

DETAILED DESCRIPTION OF THE INVENTION

Figure 1:
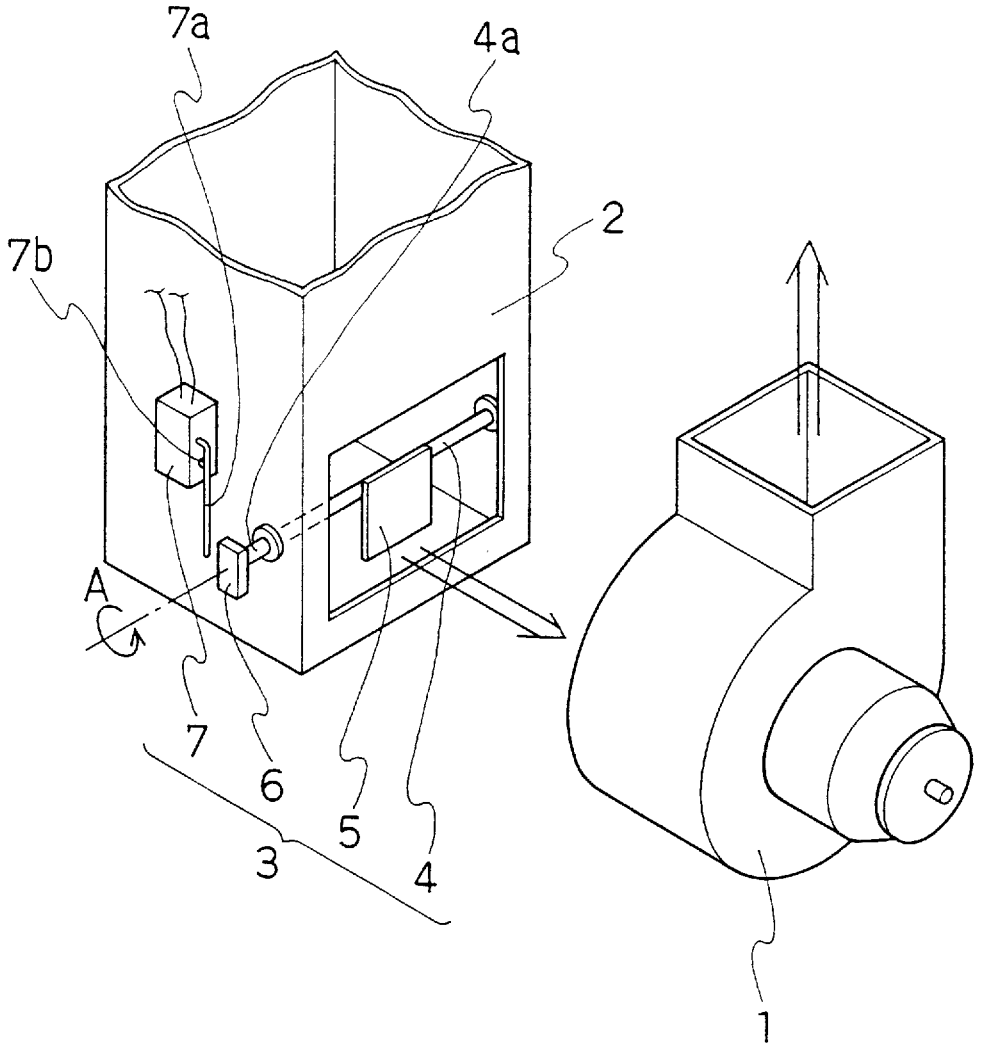
FIG. 1 is a perspective view of a main portion of one embodiment of the processing apparatus of the present invention.

Referring now to the drawings, there is explained in detail a processing apparatus of the present invention.

Figure 5:
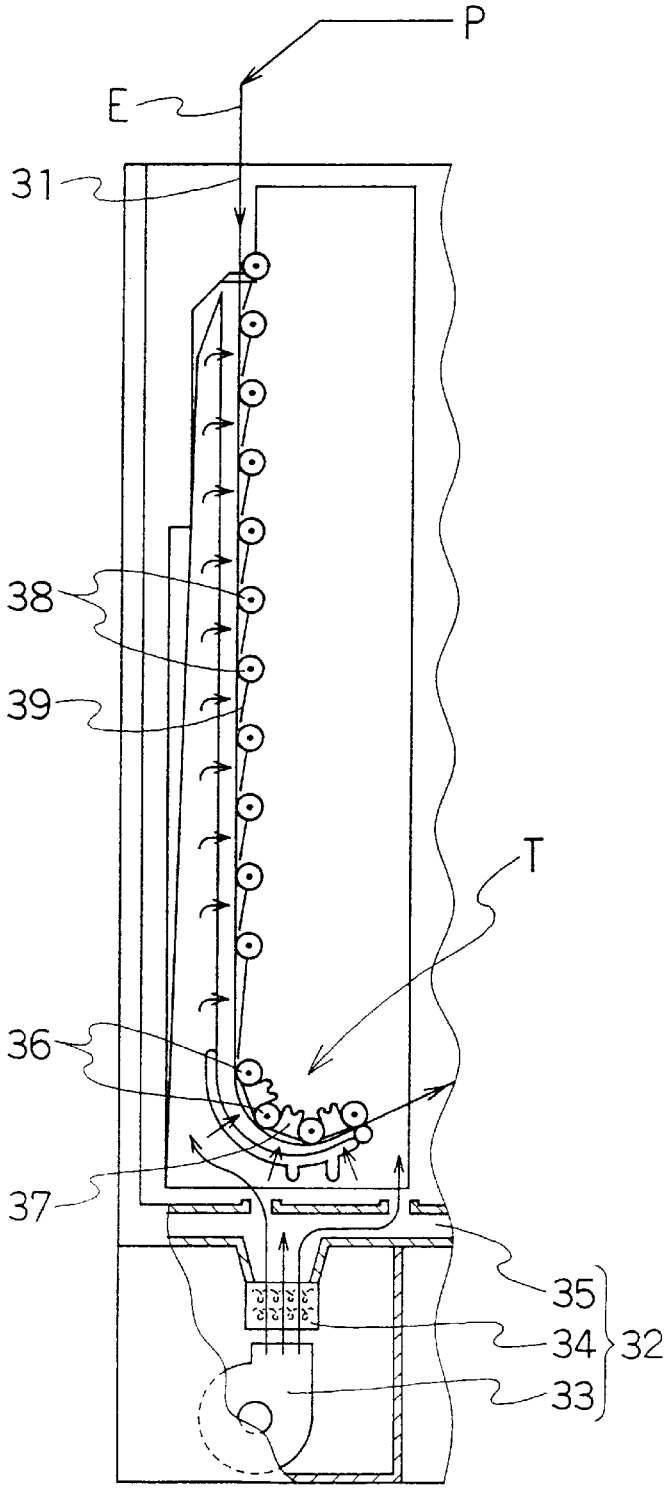
FIG. 5 is a schematic view showing the construction of the drying part of the conventional processing apparatus.

A processing apparatus in one embodiment of the present invention, like in the conventional processing apparatus shown in FIG. 5, effects developing, bleaching, fixing and washing operations in the development part, with transferring the paper along the transfer route by a roller, and then a drying operation in the drying part. Although conventional one can be adopted as a constitution for the processing operations, the constitution of the drying part is different from the conventional one.

Namely, in the drying part of the processing apparatus of the present embodiment shown in FIG. 1, an air amount reduction detecting means 3 is set within the duct 2 on the upstream side of the drying fan 1. The air amount reduction detecting means 3 is composed of a rotation shaft 4 rotatably supported within the duct 2, a flapper 5 secured onto the rotating shaft 4, a limit holding plate 6 secured onto one end of the rotating shaft 4, and a limit switch 7.

Figure 6:
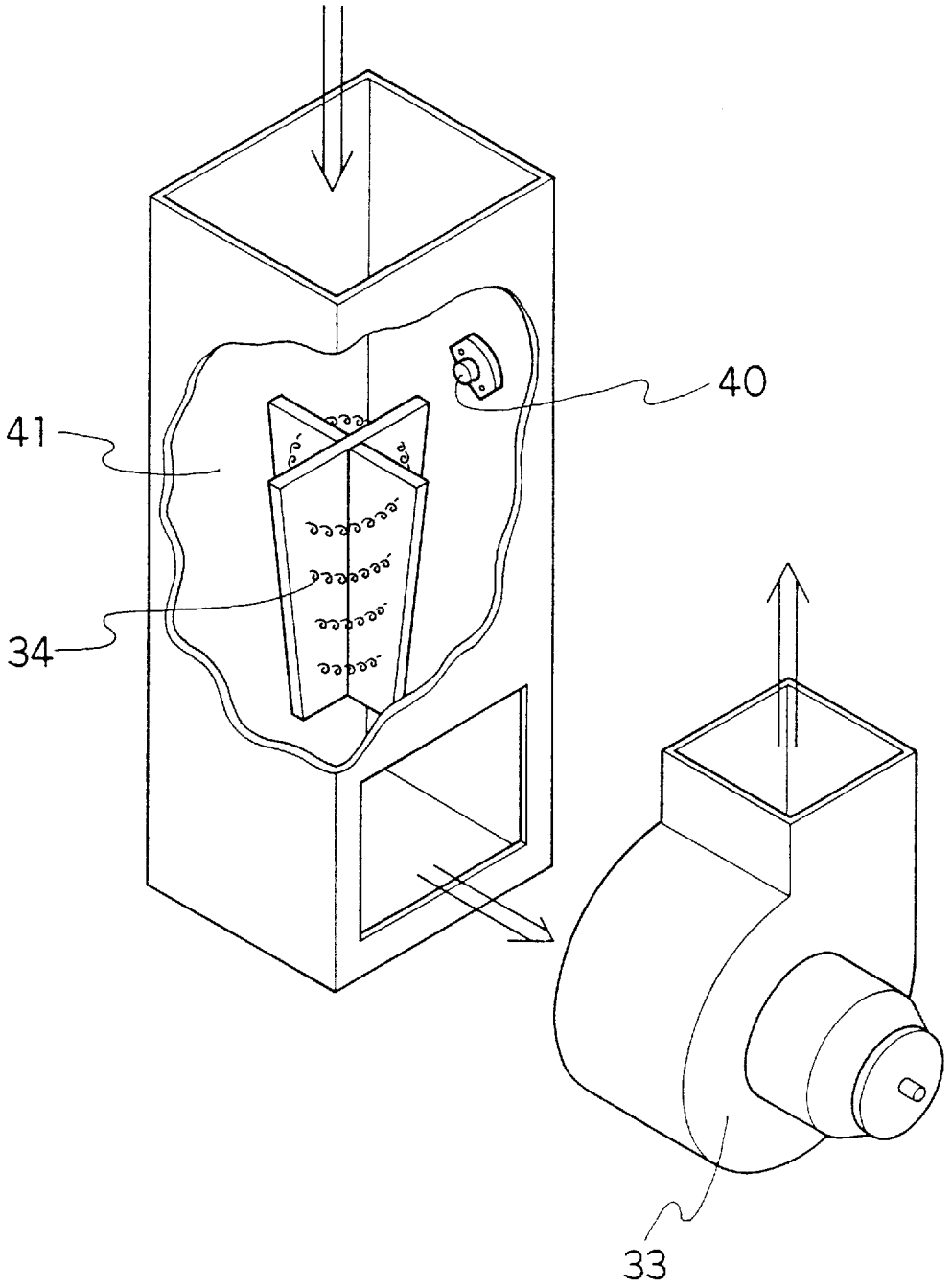
FIG. 6 is a partialy cut-away sectional view of the drying part showing a condition where a thermostat for preventing overheat capable of indirectly detecting reduction in air amount is provided.

Although not shown in FIG. 1, a drying heater, used conventionally, as shown in FIG. 6 is set within the duct 2. Also, although not shown, on the downstream side of the drying fan 1, the exhaust duct, used conventionally, as shown in FIG. 5, is set to feed hot blast through the exhaust duct to respective locations of the paper to be carried into the drying part.

In the example of FIG. 1, the flapper 5 is secured to the rotating shaft 4 within the range of at least the upper half portion thereof so that it can be oscillated depending on the change of the air pressure and correspondingly rotates the rotary shaft 4. One end of the rotating shaft 4 is projected externally of the duct 2. The limit holding plate 6 is secured to the projected tip end portion 4*a* as the detecting plate. As a detector for detecting the movement of the rotating shaft 4 by the limit holding plate 6, the limit switch 7 is secured to such a position on the external surface of the duct 2 that the arm 7*a* is depressed against the projection 7*b* by the limit holding plate 6 when the drying fan 1 is normally operating, and that the projection 7*b* is not depressed when the air amount of the drying fan 1 is reduced.

The limit holding plate 6 can be adopted in any shape if the arm 7*a* is depressed when the limit holding plage 6 has been rotated by a given angle around the rotating shaft 4, while the depressing against the arm 7*a* can be stopped when it has been rotated by a given angle in an opposite direction. Accordingly, the shape might be rectangular as shown in FIG. 1, or might be oval or semicircular or the like. Further, the eccentric cam might be employed.

Although in the embodiment, the limit switch has been explained by way of an example as a detector. The present invention is not limited to it. For example, photosensor or the like might be adopted as the other example for the detector.

In the drying part of FIG. 1, the limit holding plate 6 is rotating in a direction of an arrow A by the air pressure when the given air pressure and air amount are caused by the normal operation of the drying fan 1. The limit switch 7 is normally in the condition of On by depression of the tip end of the limit holding plate 6 against the arm 7*a* of the limit switch 7 and then the projection 7*b*. Thus, the drying fan is judged to be normally operating by a central processing unit (CPU) or the like connected with the limit switch 7.

In the case where an abnormal operation such as fan lock has been generated with the drying fan 1, the limit holding plate 6 is rotated in a direction opposite to the arrow A direction because of the lower air pressure (reduction as about half as normal pressure). At that time, the tip end of the limit holding plate 6 stops pressing the arm 7*a*, so that the arm 7*a* is separated from the projection 7*b*. As a result, the limit switch becomes off. It is judged that the abnormal operation has been caused in the drying fan by the central processing unit or the like. All the processing operations are stopped in emergency, or control of processing operation is carried out, i.e. warnings are issued by the various warning means (alarms) of buzzer or warning lamps, or messages for warnings use are displayed on a monitor.

Figure 2:
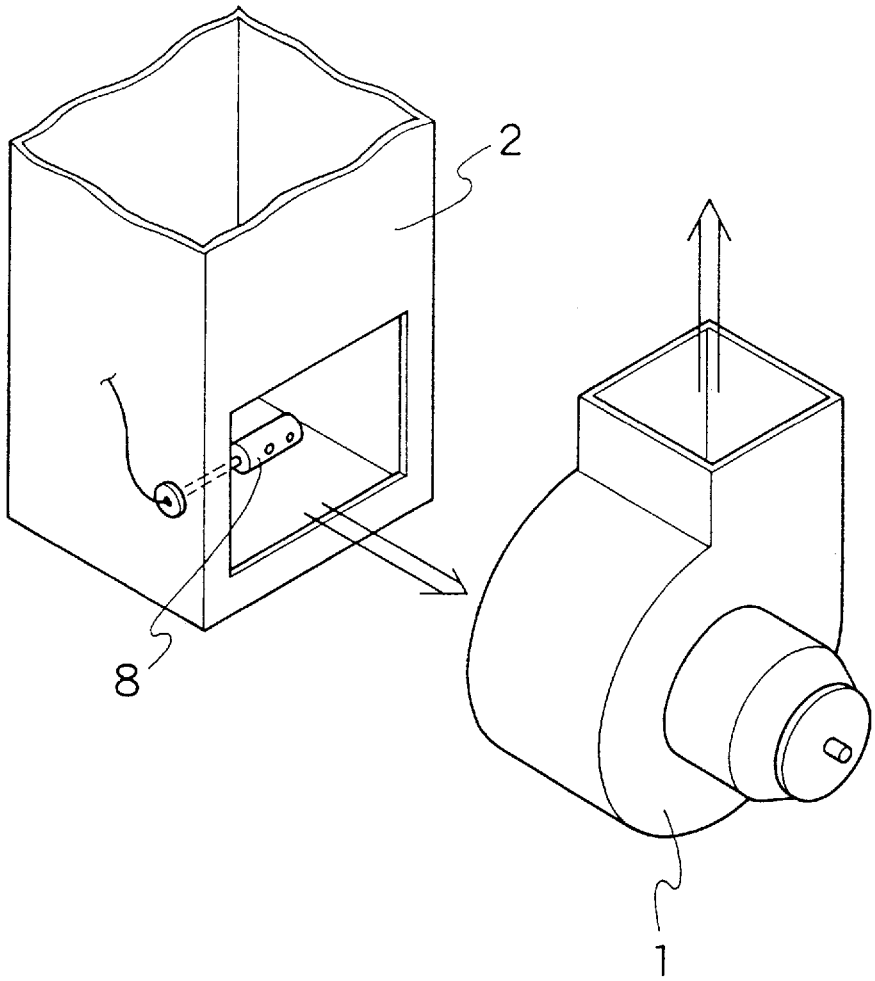
FIG. 2 is a perspective view of a main portion of another embodiment of a processing apparatus of the present invention.

Also, in the drying part of the processing apparatus shown in FIG. 2 as another embodiment of the apparatus of the present invention, an air amount or an air pressure sensor 8 is provided as an means for detecting reduction in the air amount within the duct 2 on the upstream side of the drying fan 1.

Although not shown, a drying heater conventionally used as shown in FIG. 6 is provided within the duct 2. Also, although not shown, an exhaust duct conventionally used as shown in FIG. 5 is provided to feed hot blast through the exhaust duct to each location of the paper to be carried into the drying part.

As the air amount or the air pressure sensor 8, there can be employed a means capable of measuring air amount such as conventionally used mass flow control meter, SLK-3500 or SST-3100 (both are air amount/air pressure censor made by Effector Kabushiki Kaisha), a means capable of measuring air pressure such as semiconductor pressure sensor.

Such a drying part in FIG. 2 can observe whether or not the given air pressure and air amount is caused by the normal operation of the drying fan 1 by the air amount or the air pressure sensor 8. When the air amount has been lowered (to approximately half normal or less) or the air pressure has been lowered (to approximately half of the normal pressure or less) because of the abnormal operation such as fan lock in the drying fan 1, the central processing apparatus or the like connected with the air amount or air pressure sensor 8 judges that something went wrong with the drying fan. All the processing operations are stopped in emergency, or control of processing operation is carried out, i.e. warnings are issued by the various warning means (alarms) of buzzer or warning lamps, or messages for warnings use are displayed on a monitor.

Figure 3:
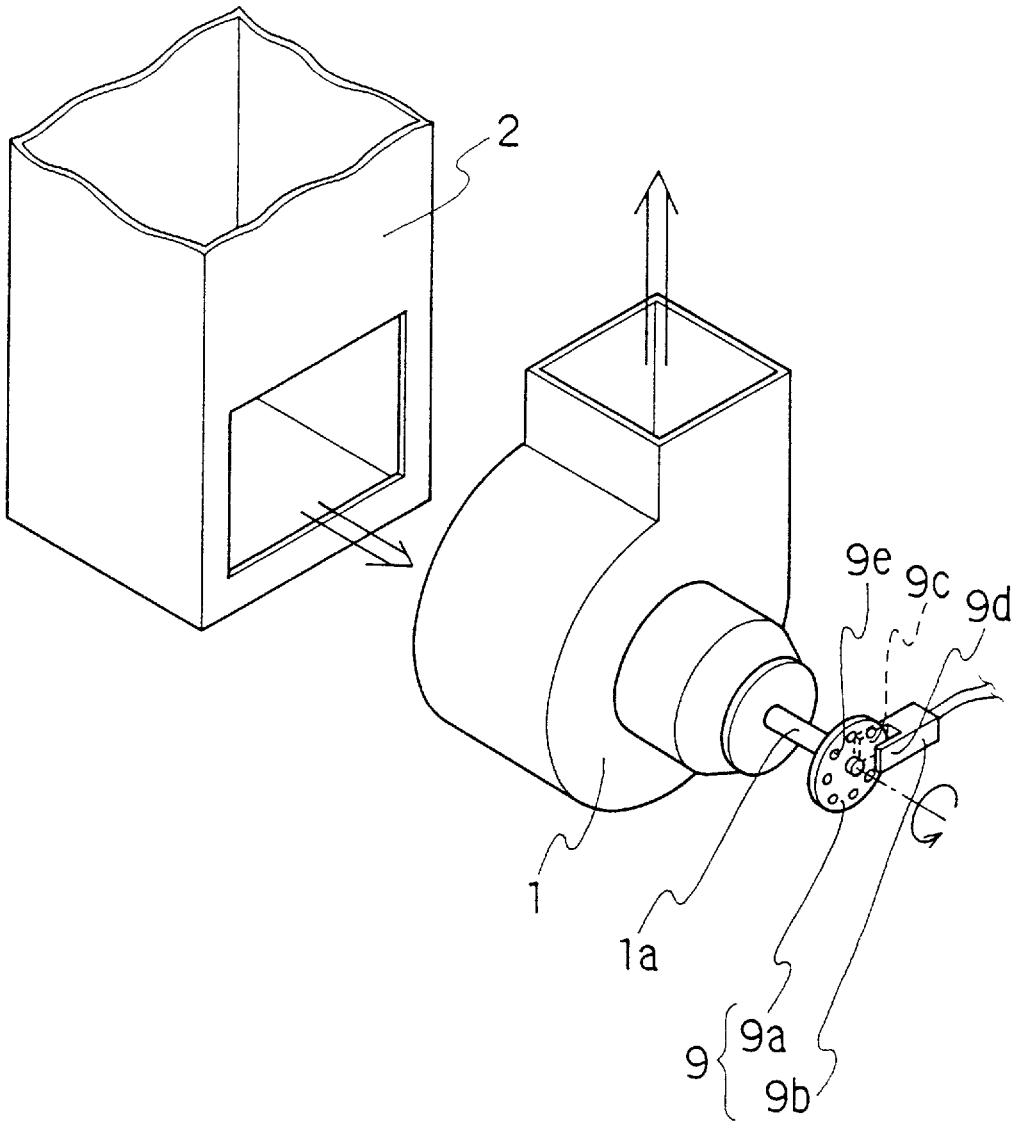
FIG. 3 is a perspective view of a main portion of still another embodiment of the processing apparatus of the present invention.

Also, as still another embodiment of the processing apparatus of the present invention, as shown in FIG. 3 a rotation detecting sensor 9 is provided in the drying part of the processing apparatus for detecting reduction in rotating speed of the driving shaft 1*a* of the drying fan 1.

Although not shown, the conventionally used drying heater as shown in FIG. 6 is provided within the duct 2. Although not shown, the conventionally used exhaust duct as shown in FIG. 5 is provided on the downstream side of the drying fan 1 to supply the hot blast through the exhaust duct to each location of the paper to be carried into the drying part.

The rotation detecting sensor 9 is composed of a rotating disc 9*c* having a plurality of holes 9*e* and secured to the tip end portion of the driving shaft 1*a*, and a counter part 9*b* with a light emitting part 9*c* and a light receiving part 9*d* oppositely provided on both the front and rear sides of the rotating disc 9*a*. The rotating speed of the driving shaft 1*a* (namely, the rotating speed of the rotating disc 9*a*) is counted by the number of the hole 9*e* of the rotating disc 9*a* passed between the light emitting part 9*c* and the light receiving part 9*d* per unit time as the number of optical pulses received by the light receiving part 9*d*.

Such a drying part in FIG. 3 can observe whether or not the given air pressure and air amount are caused by the normal rotation of the drying fan 1 at the normal rotating speed by the air amount or the rotation detecting sensor 9. When the rotating speed has been lowered (to approximately half the normal pressure or less) because of the abnormal operation such as fan lock in the drying fan 1, the central processing apparatus or the like connected with the rotation detecting sensor 9 judges that something went wrong with the drying fan. All the processing operations are stopped in emergency, or control of processing operation is carried out, i.e. warnings are issued by the various warning means (alarms) of buzzer or warning lamps, or messages for warnings use are displayed on a monitor.

Although FIG. 3 explained an example where a rotation detecting sensor has been provided on the driving shaft of the drying fan, the present invention is not limited to it. The rotation detecting sensor might be provided on the output shaft of the drying fan. In this case, the above described function can be effected.

Figure 4:
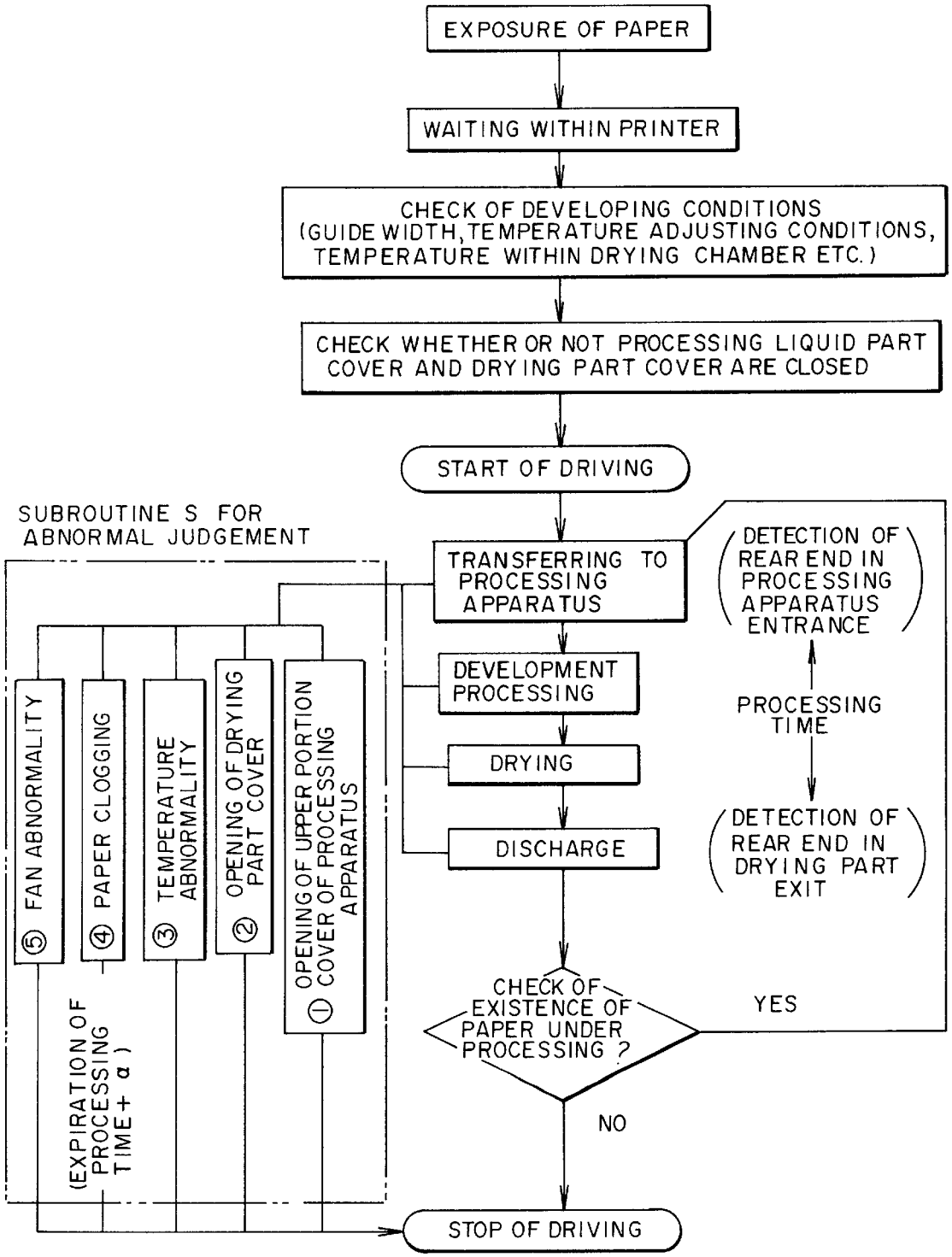
FIG. 4 is a flow chart showing one example of a controlling method of the processing operation of the processing apparatus of the present invention.

With reference to the flow chart of FIG. 4, the control of processing of the photosensitive material by the processing apparatus of the present invention is described.

Before the processing apparatus is driven, the paper is exposed in advance and then the paper is kept waiting within the printer.

The developing conditions (the guide width of the transferring route, temperature adjusting conditions, the temperature within the drying part or the like) are checked by the central processing unit or the like within the processing apparatus. Then, it is checked whether or not the processing liquid part cover and the drying part cover are closed. When something abnormal has been detected by these checks, the monitor attached or the like displays as to which item is wrong.

Then, when the driving of the processing apparatus is started, the paper is fed into the processing apparatus. A development processing in the development part is effected, then the paper is transferred to the drying part to dry, and is discharged to the outside of the drying part. When the paper is fed into the apparatus, the rear end of the paper is detected in the processing apparatus entrance by the photosensor or the like. On the other hand, when the paper is discharged to the outside of the drying part, the rear end is detected by the photosensor or the like even in the exit of the drying part to measure, as one time of processing time, the time interval between two rear end detections.

After the paper has been discharged to the outside of the drying part, the existence of the paper being processed is checked with the use of the photosensor or a touch sensor or the like provided in each location of the transferring route. When the paper remains within the processing apparatus, the paper is fed again into the processing apparatus to process a series of paper. When the paper does not exist, the driving operation of the processing apparatus stops.

While the paper is delivered to the processing apparatus to effect each step of development, drying and discharging, the following five items are checked in accordance with the subroutine S for abnormal judgment in the central processing unit or the like.

(1) Whether or not the cover of the processing liquid part is opened is checked with the use of a touch sensor or the like.

(2) Whether or not the drying part cover is opened is checked with the use of a touch sensor or the like.

(3) Whether or not the temperature of the interior of the drying part is abnormal is checked with the use of a thermostat or the like.

(4) Whether or the paper is clogged in the interior of the drying part is judged by whether or not the paper has passed through the processing apparatus by time when the correcting time portion a is added to the measured processing time.

(5) Whether or not the operation of the drying fan is abnormal is checked with the use of the air amount detecting means shown in FIG. 1 or FIG. 2.

When one among the above described (1) through (5) is judged to be true, the warnings are issued by various warning means such as buzzer and warning lamp provided on the processing apparatus while an emergency stop of the driving of the processing apparatus is effected immediately.

When the abnormal operation of the drying fan in the (5) is checked, it can be preferably checked even by the rotation detecting sensor shown in FIG. 3 in addition to the air amount detecting means.

The processing apparatus in accordance with the first invention reduces paper loss, because the drying part has a means for detecting reduction in air amount of the drying fan so that the operation of the warning means, the paper transferring operation or the like can be quickly effected by the direct and quick detection of the abnormal drying fan operation. Also, since the paper is not transferred in a condition where the paper clogging operation exists at the abnormal operation of the drying fan, the secondary troubles such as parts failures or the like are avoided.

The driving control can be effected with high reliability, because the sensitivity is not influenced at all by the external temperature because of direct detection of the reduction in the air amount without the use of the temperature detecting means or the like.

The processing apparatus in accordance with the second invention reduces paper loss, because the drying part has a rotation detecting sensor for detecting reduction in rotation speed of the driving shaft or the output shaft of the drying fan so that the operation of the warning means or the paper transferring operation can be quickly effected by the direct and quick detection of the abnormal drying fan operation. Also, since the paper is not transferred in a condition where the paper clogged exists at the abnormal operation of the drying fan, the secondary troubles such as parts failure or the like are avoided.

The driving control can be effected with high reliability, because the sensitivity is not influenced at all by the external temperatures because of direct detection of the reduction in the rotating speed without the use of temperature detecting means or the like.

What is claimed is:

1. A processing apparatus to automatically develop a photosensitive material, said apparatus comprising a drying part that includes:

a drying heater heating air to dry the photosensitive material;

a drying fan circulating the air heated by said drying heater inside said drying part; and a means for detecting a reduction in the air circulation by said drying fan.

2. An apparatus of claim 1, wherein said means for detecting the reduction in the air circulation comprises:

a rotary shaft supported rotatably within a duct which is upstream or downstream of the drying fan;

a flapper secured to the rotary shaft to rotate the rotary shaft during the air circulation;

a detecting plate secured to one end of the rotary shaft; and a detector detecting reduced movement of the rotary shaft using the detecting plate when the air circulation of said drying fan is reduced.

3. An apparatus of claim 1, wherein said means for detecting the reduction in the air circulation comprises either an air amount sensor or an air pressure sensor.

4. An apparatus of claims 1 to 3, further comprising:

a means for detecting a rise of temperature inside said drying part;

a means for detecting a clogging of photosensitive material inside said drying part; and a control processor controlling processing of the photosensitive material based on an abnormal detection signal obtained from at least one of said three types of detecting means.

5. An apparatus of claim 4, further comprising a warning means for generating a warning; and wherein said control processor controls processing of the photosensitive material by issuing warnings using said warning means when the abnormal detection signal is received and stops the processing of the photosensitive material.

6. A processing apparatus to automatically develop a photosensitive material, said apparatus comprising a drying part that includes:

a drying heater heating air to dry the photosensitive material;

a drying fan circulating the air heated by said drying heater inside said drying part, said drying fan having at least one of a driving shaft and an output shaft; and a rotation detecting sensor detecting a reduction of a rotation speed of at least one of said driving shaft and said output shaft of said drying fan.

7. An apparatus of claim 6, further comprising:

a means for detecting a rise of temperature inside said drying part;

a means for detecting a clogging of photosensitive material inside said drying part; and a control processor controlling processing of the photosensitive material based on an abnormal detection signal obtained from at least one of said two types of detecting means and said rotation detecting sensor.

8. An apparatus of claim 7, further comprising a warning means for generating a warning; and wherein said control processor controls processing of the photosensitive material by issuing warnings using said warning means when the abnormal detection signal is received and stops the processing of the photosensitive material.

* * * * *